US009738289B2

(12) United States Patent
Strahan

(10) Patent No.: US 9,738,289 B2
(45) Date of Patent: Aug. 22, 2017

(54) CART AND TRACK ASSEMBLY

(71) Applicant: Jeffrey L. Strahan, Lansing, MI (US)

(72) Inventor: Jeffrey L. Strahan, Lansing, MI (US)

( * ) Notice: Subject to any disclaimer, the term of this patent is extended or adjusted under 35 U.S.C. 154(b) by 177 days.

(21) Appl. No.: 14/641,617

(22) Filed: Mar. 9, 2015

(65) Prior Publication Data

US 2016/0264151 A1 Sep. 15, 2016

(51) Int. Cl.
*B61B 1/00* (2006.01)
*E01B 25/00* (2006.01)

(52) U.S. Cl.
CPC ..... *B61B 1/00* (2013.01)

(58) Field of Classification Search
CPC .. B61B 1/00; B61B 1/005; B61B 1/02; E01B 2/00; E01B 2/003; E01B 3/00; E01B 5/00; E01B 5/02; E01B 25/00; E01B 25/02
See application file for complete search history.

(56) References Cited

U.S. PATENT DOCUMENTS 4,065,006 A * 12/1977 Barry ..... B61B 1/005 104/18
4,159,844 A 7/1979 Weiner
4,669,657 A * 6/1987 Crain ..... A63H 19/36 238/10 A
5,125,710 A 6/1992 Gianelo
5,176,082 A * 1/1993 Chun ..... B61B 1/02 104/28
5,628,153 A 5/1997 Fontanez
D398,728 S 9/1998 Osborne, Jr.
6,248,411 B1 * 6/2001 Warfel ..... B44C 3/042 428/132
D483,564 S 12/2003 McKeegan
8,239,080 B2 * 8/2012 Chun ..... B61B 1/00 246/2 R
8,661,739 B2 3/2014 Keenan
2007/0028529 A1 2/2007 Carter
2012/0175369 A1 7/2012 Toro

* cited by examiner

*Primary Examiner* — R. J. McCarry, Jr.

(57) ABSTRACT

A cart and track assembly includes a track that may be positioned on a support surface. The track may be positioned beneath a structure such that the track extends outwardly from beneath the structure. A cart is rollably positioned upon the track and the cart may have an object positioned thereon such that the object is movable along the track. The cart shelters the object beneath the structure and transports the object outwardly from beneath the structure. A plurality of wheels is rollably attached to the cart and each of the wheels rolls along the track.

4 Claims, 4 Drawing Sheets

CART AND TRACK ASSEMBLY

BACKGROUND OF THE DISCLOSURE

Field of the Disclosure

The disclosure relates to cart devices and more particularly pertains to a new cart device for allowing a heavy object to be rolled outwardly from beneath a structure.

SUMMARY OF THE DISCLOSURE

An embodiment of the disclosure meets the needs presented above by generally comprising a track that may be positioned on a support surface. The track may be positioned beneath a structure such that the track extends outwardly from beneath the structure. A cart is rollably positioned upon the track and the cart may have an object positioned thereon such that the object is movable along the track. The cart shelters the object beneath the structure and transports the object outwardly from beneath the structure. A plurality of wheels is rollably attached to the cart and each of the wheels rolls along the track.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
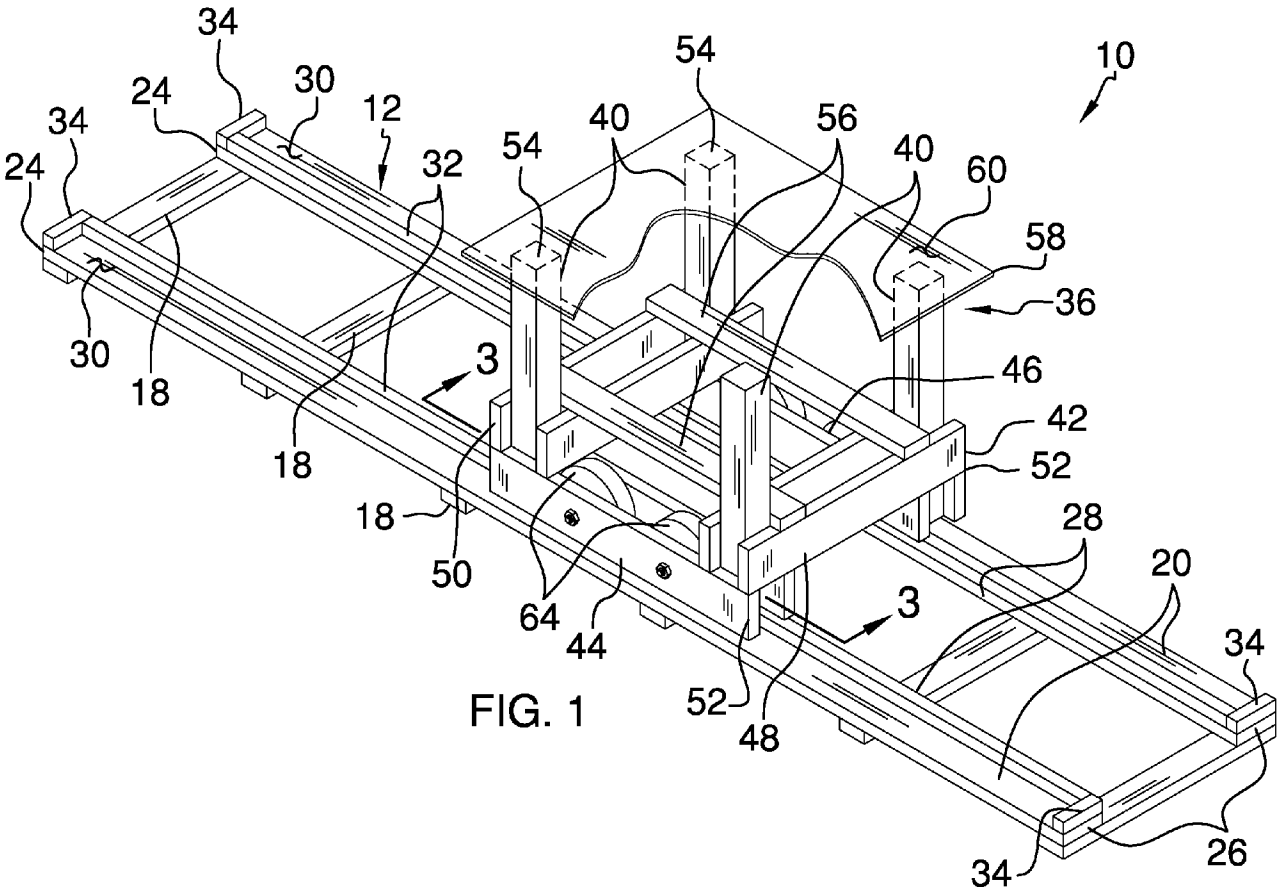
FIG. 1 is a top perspective view of a cart and track assembly according to an embodiment of the disclosure.
Figure 2:
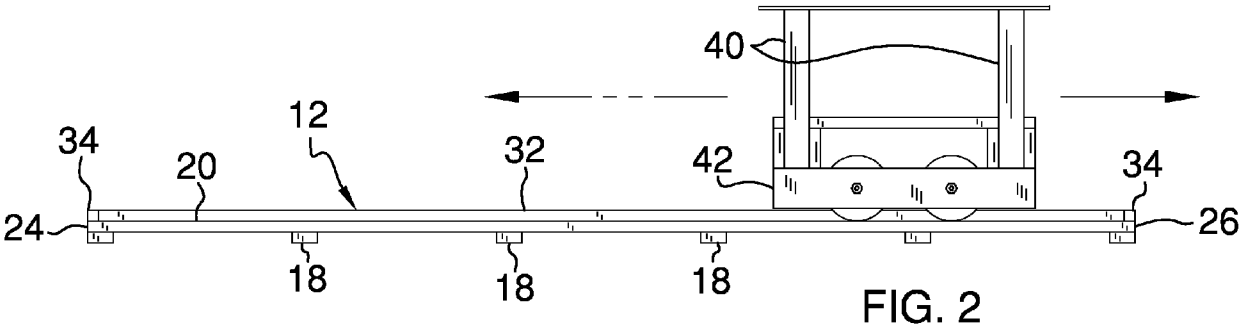
FIG. 2 is a right side view of an embodiment of the disclosure.
Figure 3:
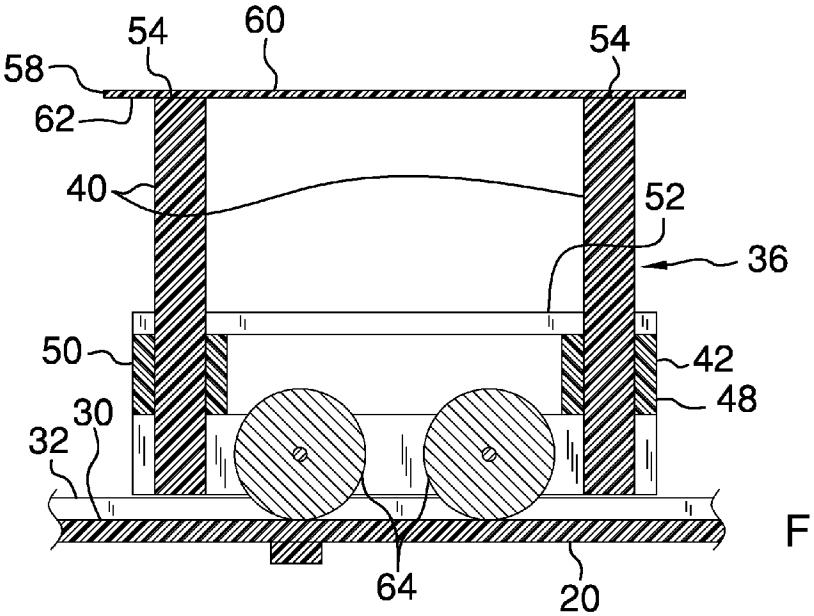
FIG. 3 is a cross sectional view taken along line 3-3 of FIG. 1 of an embodiment of the disclosure.
Figure 4:
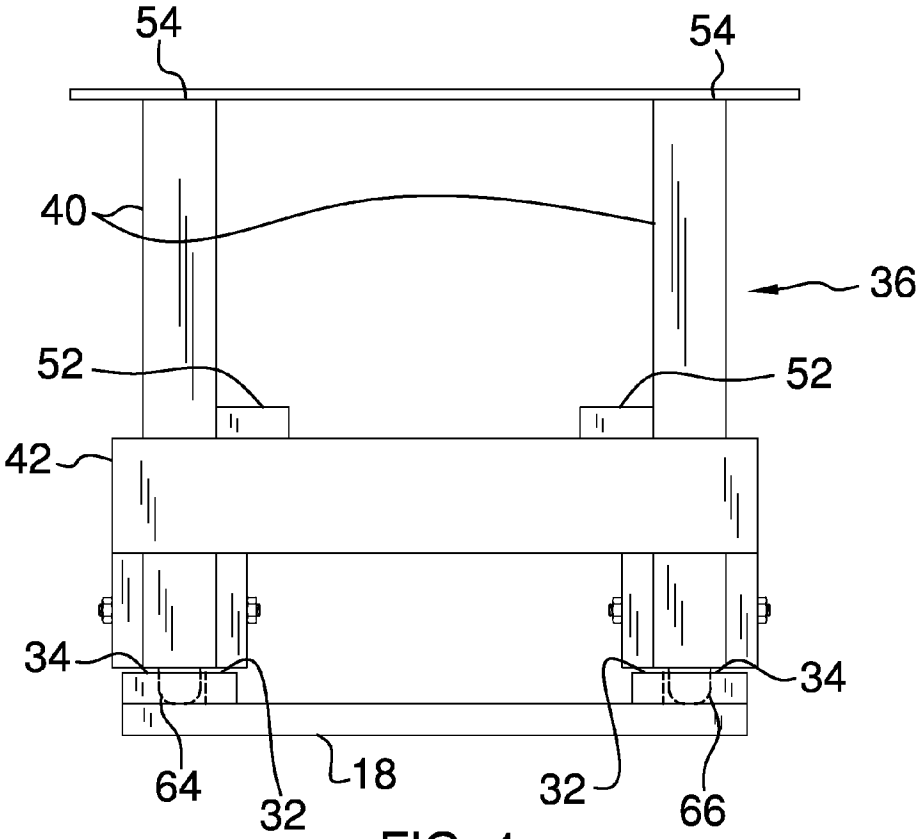
FIG. 4 is a front view of an embodiment of the disclosure.
Figure 5:
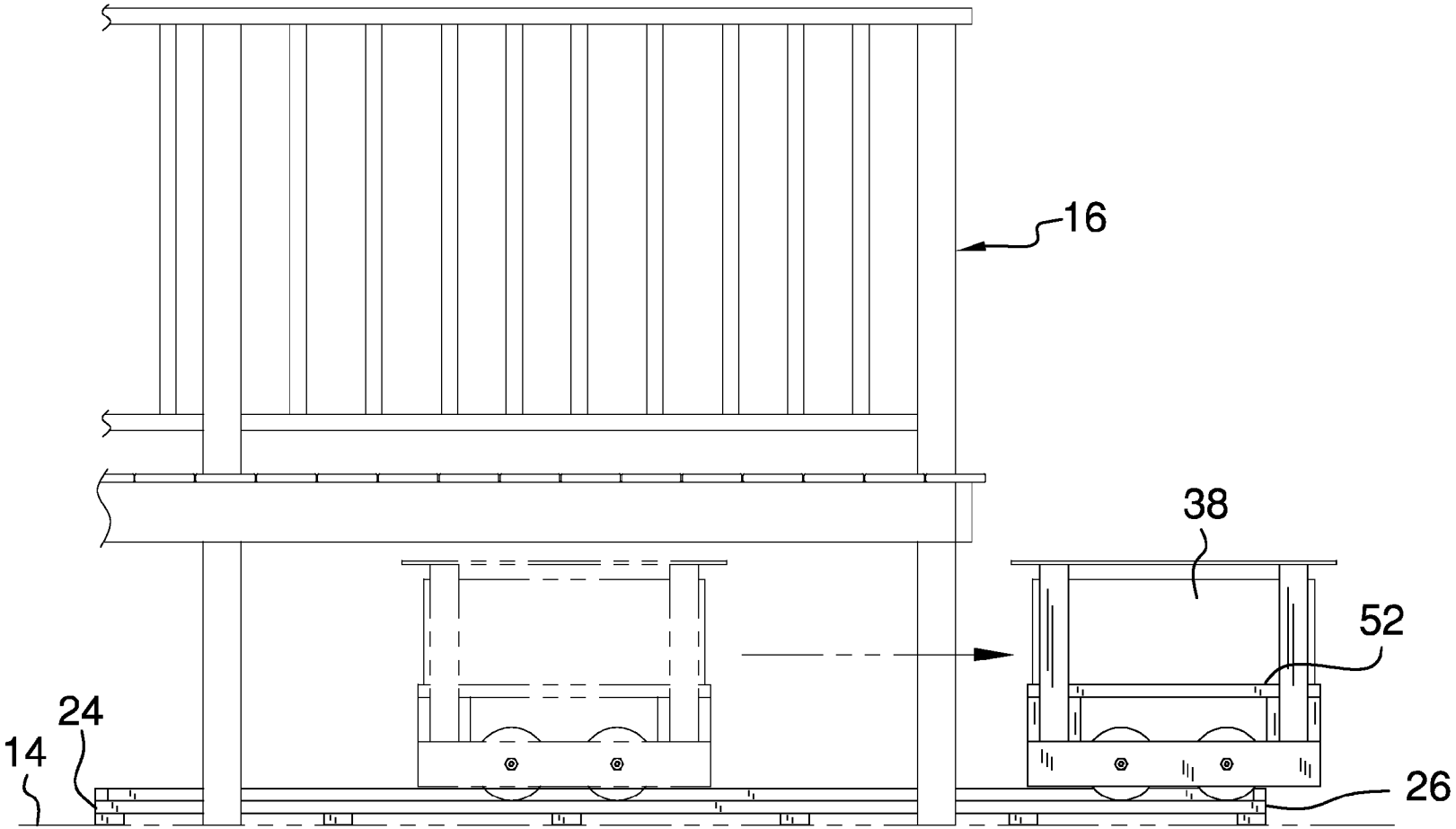
FIG. 5 is a perspective in-use view of an embodiment of the disclosure.

With reference now to the drawings, and in particular to FIGS. 1 through 5 thereof, a new cart device embodying the principles and concepts of an embodiment of the disclosure and generally designated by the reference numeral 10 will be described.

As best illustrated in FIGS. 1 through 5, the cart and track assembly 10 generally comprises a track 12 that may be positioned on a support surface 14. Additionally, the track 12 may be positioned beneath a structure 16 such that the track 12 extends outwardly from beneath the structure 16. The support surface 14 may be ground and the structure 16 may be a deck or the like that is elevated from the support surface 14.

The track 12 comprises a plurality of lateral members 18 each coupled to and extending between a pair of longitudinal members 20. Each of the longitudinal members 20 has a first end 24 and a second end 26 and each of the lateral members 18 is spaced apart from each other and distributed between the first end 24 and the second end 26. Each of the longitudinal members 20 has an inwardly facing edge 28 and a top surface 30 and the top surface 30 of each of the longitudinal members 20 has a lip 32 extending upwardly therefrom. The lip 32 extends between the first end 24 and the second end 26 and the lip 32 is positioned adjacent to the inwardly facing edge 28. The lip 32 on each of the longitudinal members 20 extends outwardly from the inwardly facing edge 28 along each of the first end 24 and the second end 26 to define a pair of stops 34 on each of the longitudinal members 20. The track 12 may have a width ranging between approximately 24 inches and 36 inches and a length ranging between approximately 12 feet and 20 feet.

A cart 36 is rollably positioned upon the track 12 and the cart 36 may have an object 38 positioned thereon such that the object 38 is movable along the track 12. The cart 36 shelters the object 38 beneath the structure 16 and transports the object 38 outwardly from beneath the structure 16. The object 38 may be a gas generator or other object that is difficult to move due to being heavy. The cart 36 comprises a plurality of arms 40 and a base 42. The base 42 has a first lateral side 44, a second lateral side 46, a front side 48 and a back side 50 and each of the arms 40 is coupled to and extends upwardly from the base 42. Each of the arms 40 is positioned adjacent to one of four corners 52 of the base 42 and each of the arms 40 has a distal end 54 with respect to the base 42.

The base 42 includes a pair of supports 56 attached thereto and each of the supports 56 extends between the front side 48 and the back side 50 of the base 42. Each of the supports 56 is spaced apart from each other and each of the supports 45 support the object 38. The cart 36 includes a panel 58 that has a top surface 60 and a bottom surface 62. The bottom surface 62 rests on the distal end 54 of each of the arms 40 and the panel 58 covers the object 38 and the panel 58 may be secured to the cart 36 using a fastener or the like.

A plurality of wheels 64 is provided and each of the wheels 64 is rollably attached to the cart 36. Each of the wheels 64 may be inflatable, rubber wheels or the like thereby facilitate the cart 36 to have a weight capacity ranging between approximately 200 pounds and 400 pounds. The plurality of wheels 64 comprises a first set of wheels 66 and a second set of wheels 68. The first set of wheels 66 is positioned on the first lateral side 44 and the first set of wheels 66 rolls along the top surface 30 of one of the longitudinal members 20. The second set of wheels 68 is positioned on the second lateral side 46 and the second set of wheels 68 rolls along the top surface 30 of one of the longitudinal members 20. The lip 32 on each of the longitudinal members 20 prevents the cart 36 from rolling off of the longitudinal members 20 and the cart 36 is rollable between the stops 34 on the longitudinal members 20.

In use, the track 12 is positioned beneath the structure 16 so the first end 24 of the track 12 is positioned beneath the structure 16 and the second end 26 of the track 12 is exposed and accessible. The object 38 is placed upon the supports 56 on the base 42 and the panel 58 is placed on the distal end 54 of the arms 40. The cart 36 is rolled to be positioned adjacent to the first end 24 of the track 12 in order to store and shelter the object 38. The cart 36 is rolled toward the second end 26 of the track 12 so the object 38 is accessible when the object 38 is to be utilized. The cart 36 allows one individual to easily move the object 38 along the track 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cart and track assembly configured to store and transport a heavy object, said assembly comprising:

a track configured to be positioned on a support surface, said track being configured to be positioned beneath a structure such that the track extends outwardly from beneath the structure, said track comprising a plurality of lateral members each coupled to and extending between a pair of longitudinal members, each of said longitudinal members having a first end and a second end, each of said lateral members being spaced apart from each other and distributed between said first end and said second end, each of said longitudinal members having an inwardly facing edge and a top surface, said top surface of each of said longitudinal members having a lip extending upwardly therefrom, said lip extending between said first end and said second end, said lip being positioned adjacent to said inwardly facing edge, said lip on each of said longitudinal members extending outwardly from said inwardly facing edge along each of said first end and said second end to define a pair of stops on each of said longitudinal members;

a cart rollably positioned upon said track, said cart being configured to have an object positioned thereon such that the object is movable along said track, said cart being configured to shelter the object beneath the structure and to transport the object outwardly from beneath the structure; and a plurality of wheels, each of said wheels being inflatable and rollably attached to said cart on a respective fixed axle extending between an associated pair of lateral guides, each of said wheels rolling along said track on said top surface of an associated one of said longitudinal members adjacent to said lip extending upwardly from said associated one of said longitudinal members.

2. The assembly according to claim 1, wherein said cart comprises a plurality of arms and a base, said base having a first lateral side, a second lateral side, a front side and a back side, each of said arms being coupled to and extending upwardly from said base, each of said arms being positioned adjacent to one of four corners of said base, each of said arms having a distal end with respect to said base.

3. The assembly according to claim 2, wherein said base includes a pair of supports attached thereto, each of said supports extending between said front side and said back side, each of said supports being spaced apart from each other, each of said supports being configured to support an object, said cart including a panel having a top surface and a bottom surface, said bottom surface being positioned to rest on said distal end of each of said arms, said panel being configured to cover the object.

4. A cart and track assembly configured to store and transport a heavy object, said assembly comprising:

a track configured to be positioned on a support surface, said track being configured to be positioned beneath a structure such that the track extends outwardly from beneath the structure, said track comprising a plurality of lateral members each coupled to and extending between a pair of longitudinal members, each of said longitudinal members having a first end and a second end, each of said lateral members being spaced apart from each other and distributed between said first end and said second end, each of said longitudinal members having an inwardly facing edge and a top surface, said top surface of each of said longitudinal members having a lip extending upwardly therefrom, said lip extending between said first end and said second end, said lip being positioned adjacent to said inwardly facing edge, said lip on each of said longitudinal members extending outwardly from said inwardly facing edge along each of said first end and said second end to define a pair of stops on each of said longitudinal members;

a cart rollably positioned upon said track, said cart being configured to have an object positioned thereon such that the object is movable along said track, said cart being configured to shelter the object beneath the structure and to transport the object outwardly from beneath the structure, said cart comprising a plurality of arms and a base, said base having a first lateral side, a second lateral side, a front side and a back side, each of said arms being coupled to and extending upwardly from said base, each of said arms being positioned adjacent to one of four corners of said base, each of said arms having a distal end with respect to said base, said base including a pair of supports attached thereto, each of said supports extending between said front side and said back side, each of said supports being spaced apart from each other, each of said supports being configured to support the object, said cart including a panel having a top surface and a bottom surface, said bottom surface being positioned to rest on said distal end of each of said arms, said panel being configured to cover the object; and a plurality of wheels, each of said wheels being inflatable and rollably attached to said cart on a respective fixed axle extending between an associated pair of lateral guides of said cart, each of said wheels rolling along said track on said top surface of an associated one of said longitudinal members adjacent to said lip extending upwardly from said associated one of said longitudinal members, each of said plurality of wheels being positioned on said base, each of said wheels being positioned adjacent to one of said four corners of said base, said plurality of wheels comprising a first set of wheels and a second set of wheels, said first set of wheels being positioned on said first lateral side, said second set of wheels being positioned on said second lateral side, said lip on each of said longitudinal members preventing said cart from rolling off of said longitudinal members, said cart being rollable between said stops on said longitudinal members.

* * * * *